US006584651B2

(12) United States Patent
Leifeld et al.

(10) Patent No.: US 6,584,651 B2
(45) Date of Patent: Jul. 1, 2003

(54) DEVICE FOR INCREASING THE SPECIFIC WEIGHT OF FIBER MATERIAL IN A CARDING MACHINE

(75) Inventors: Ferdinand Leifeld, Kempen (DE); Bernhard Rübenach, Mönchengladbach (DE)

(73) Assignee: Trutzschler GmbH Co. KG, Monchengladbach (DE)

( * ) Notice: Subject to any disclaimer, the term of this patent is extended or adjusted under 35 U.S.C. 154(b) by 0 days.

(21) Appl. No.: 09/845,180

(22) Filed: May 1, 2001

(65) Prior Publication Data

US 2001/0039695 A1 Nov. 15, 2001

(30) Foreign Application Priority Data

May 11, 2000 (DE) ..... 100 23 011

(51) Int. Cl.[7] ..... D01G 25/00
(52) U.S. Cl. ..... 19/150; 19/105
(58) Field of Search ..... 19/65 CR, 65 A, 19/98, 100, 101, 105, 106 R, 106 A, 108, 112, 150, 157, 236, 239

(56) References Cited

U.S. PATENT DOCUMENTS 766,486 A * 8/1904 Barber ..... 19/105
2,937,413 A * 5/1960 Hollingsworth ..... 19/114
3,481,004 A * 12/1969 Wright et al. ..... 19/150
4,274,178 A * 6/1981 Hotta ..... 19/106 R
4,299,011 A * 11/1981 Rothen et al. ..... 19/106 R
4,374,448 A * 2/1983 Loffler ..... 19/106 R
4,779,310 A * 10/1988 Leifeld ..... 19/105
6,286,188 B1 * 9/2001 Muller et al. ..... 19/239

FOREIGN PATENT DOCUMENTS

| | | |
|---|---|---|
| EP | 0 518 801 | 12/1992 |
| GB | 2 202 554 | 9/1888 |
| GB | 1 120 222 | 7/1968 |
| GB | 2 018 317 | 10/1979 |
| GB | 2 281 919 | 3/1995 |
| GB | 2 335 664 | 9/1999 |

* cited by examiner

*Primary Examiner*—Gary L Welch

(57) ABSTRACT

A carding machine includes a main carding cylinder and a doffer to which fiber material is transferred from the main carding cylinder and a fiber removing device positioned downstream of the doffer as viewed in an advancing direction of the fiber material through the carding machine. A gathering device including at least one gathering roll is disposed downstream of the doffer for effecting a negative draft on the fiber material between the doffer and the gathering roll.

30 Claims, 2 Drawing Sheets

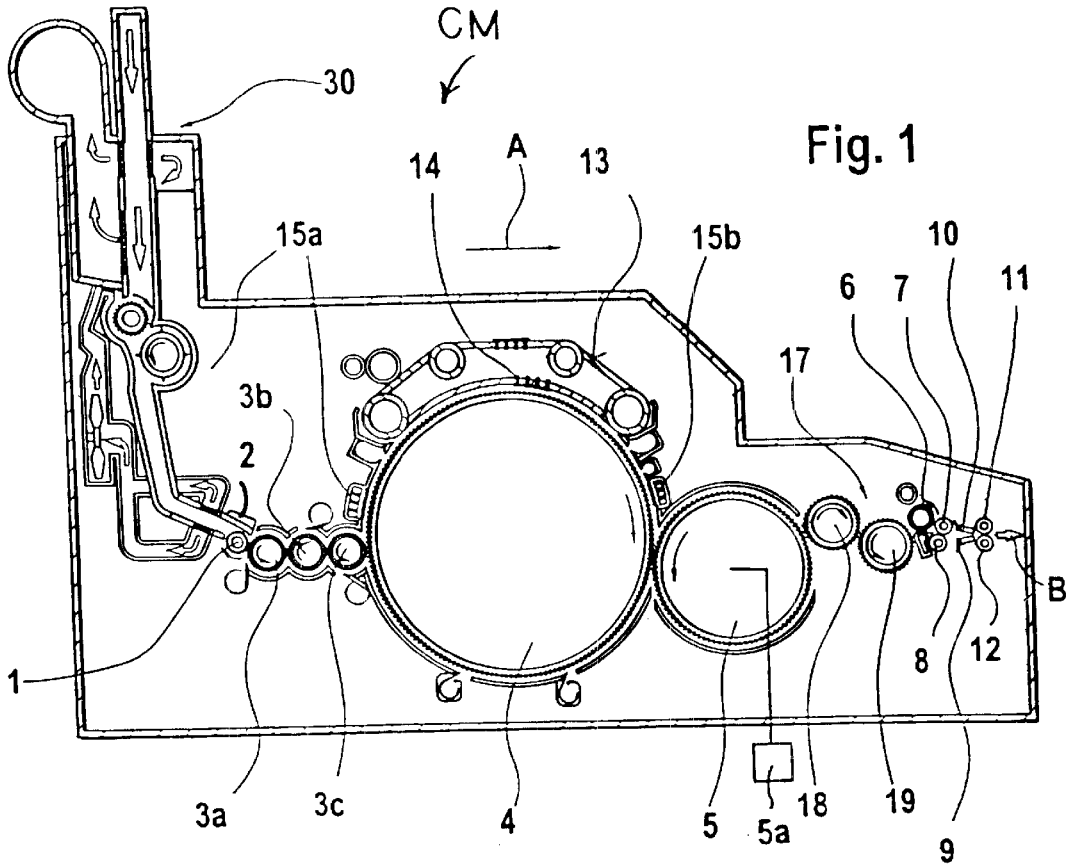
Fig. 1
Fig. 2
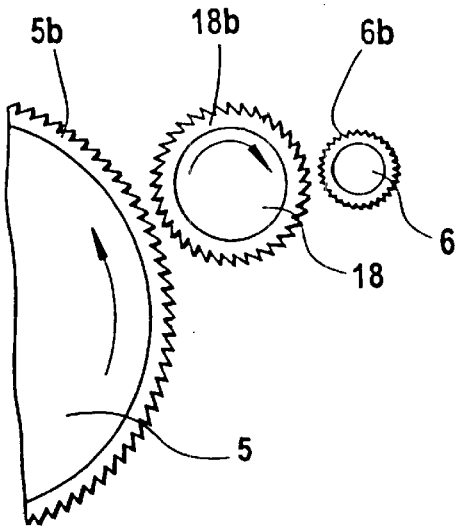
Fig. 3
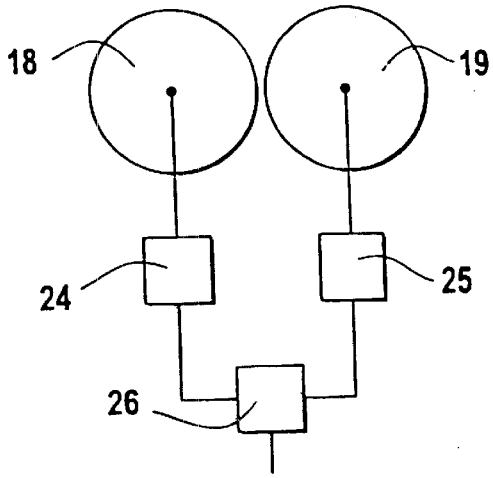

DEVICE FOR INCREASING THE SPECIFIC WEIGHT OF FIBER MATERIAL IN A CARDING MACHINE

CROSS REFERENCE TO RELATED APPLICATION

This application claims the priority of German Application No. 100 23 011.3 filed May 11, 2000, which is incorporated herein by reference.

BACKGROUND OF THE INVENTION

This invention relates to a device which forms an integral part of a carding machine and which processes fiber material, particularly cotton, chemical fibers or the like. The carding machine includes a main carding cylinder followed by a doffer and a pull-off (withdrawing) device for the fiber material.

In a known apparatus, as disclosed, for example, in German Offenlegungsschrift (application published without examination) No. 23 64 262, two doffers are provided which take the fiber material off the main carding cylinder. The two doffers are disposed with respect to the carding cylinder and with respect to one another in such a manner that each doffer cooperates with both the carding cylinder and with the other, adjacent doffer and further, a web stripping device cooperates with one of the doffers. The two doffers rotate in opposite directions with respect to the main carding cylinder. An increased production rate is intended by the provision of the two doffers and their arrangement with respect to the carding cylinder and to one another. It is a condition of such a prior art arrangement that the carding cylinder process a fiber quantity which is approximately twice the usual amount handled by a carding cylinder. For such an increased fiber amount the cylinder clothing must be coarser to increase its processing capacity. This disadvantageously reduces the carding quality to a significant extent.

SUMMARY OF THE INVENTION

It is an object of the invention to provide an improved fiber processing device of the above-outlined type from which the discussed disadvantages are eliminated and with which a fiber web of increased specific weight may be obtained without adversely affecting the carding quality.

This object and others to become apparent as the specification progresses, are accomplished by the invention, according to which, briefly stated, the carding machine includes a main carding cylinder and a doffer to which fiber material is transferred from the main carding cylinder and a fiber removing device positioned downstream of the doffer as viewed in an advancing direction of the fiber material through the carding machine. A gathering device including at least one gathering roll is disposed downstream of the doffer for effecting a negative draft on the fiber material between the doffer and the gathering roll.

The fiber gathering device, including at least one fiber gathering (fiber accumulating) roll, results in a negative draft of the fiber material: The gathering rolls accumulate and densify the fiber material, whereby an increased specific weight (quantity per surface or length) of the fiber web is obtained. The fiber web or sliver of increased specific weight is advantageously adapted for further processing, for example, into articles of hygiene.

BRIEF DESCRIPTION OF THE DRAWINGS

FIG. 1 is a schematic side elevational view of a travelling flats-type carding machine including a gathering device according to the invention.

FIG. 2 is a schematic side elevational view of a gathering roll disposed between a doffer and a stripping roll.

FIG. 3 is a schematic view of two gathering rolls with rpm-controlled drives.

DESCRIPTION OF THE PREFERRED EMBODIMENTS

Figure 4:
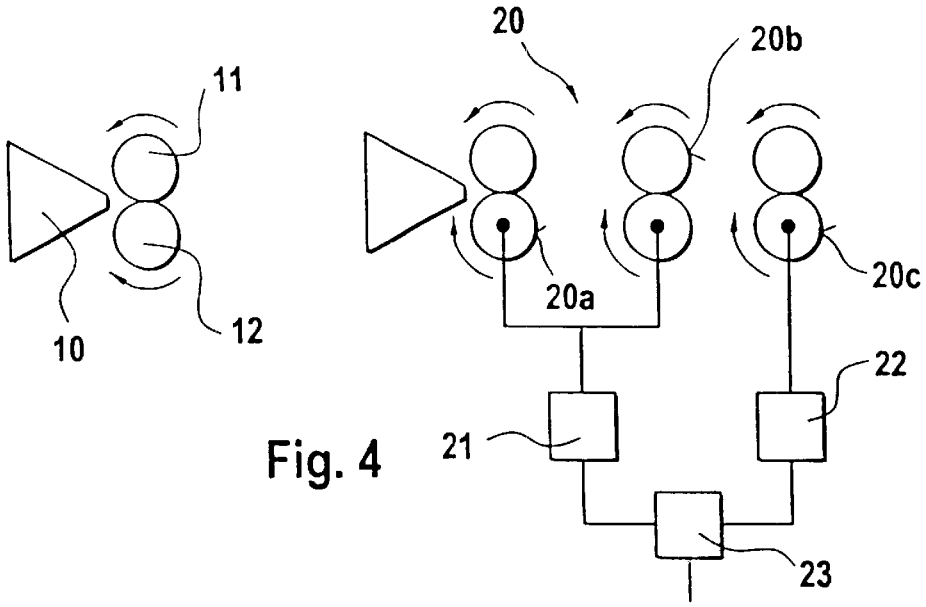
FIG. 4 is a schematic side elevational view of a sliver draw unit following a sliver forming device.

FIG. 1 shows a carding machine CM which may be a high-performance DK 903 model manufactured by Trüftzschler GmbH & Co. KG, Mönchengladbach, Germany. The carding machine CM has a feed roll 1, a feed table 2 cooperating with the feed roll 1, licker-ins 3*a*, 3*b*, 3*c*, a main carding cylinder 4, a doffer 5, a stripping roll 6, crushing rolls 7, 8, a web guiding element 9, a sliver trumpet 10, calender rolls 11, 12, a traveling flats assembly 13 having slowly circulating flat bars 14 (whose speed is between 0.05 and 0.4 m/min) and stationary carding elements 15*a*, 15*b*. The doffer 5 is rotated by a symbolically shown drive 5*a*. The directions of rotation of the rolls are shown by curved arrows drawn therein. The width of the rolls is between 1 and 1.5 m. The fiber processing direction, that is, the travel direction of the fiber material through the carding machine is indicated at A, while B designates the sliver discharged by the calender rolls 11, 12. The carding machine CM serves particularly for the processing of cotton and/or chemical fibers.

The carding machine CM may be supplied with fiber material by an upstream-connected fiber feeder 30 which may be a DIRECTFEED DFK model, manufactured by Trützschler GmbH & Co. KG.

According to the invention two gathering rolls 18 and 19 are disposed between the doffer 5 and the stripping roll 6. The first gathering roll 18 cooperates upstream with the doffer 5 and downstream with the second gathering roll 19. The doffer 5 and the second gathering roll 19 rotate co directionally, while the first gathering roll 18 rotates in the opposite direction. The circumferential speed of the first gathering roll 18 is less than that of the doffer 5, whereas the circumferential speed of the second gathering roll 19 is less than that of the first gathering roll 18. In this manner the fiber material is slowed down and accumulated. The circumferential speed of the doffer 5 may be, for example, 5 m/sec and that of the stripping roll 6 may be 8 m/sec. The circumferential speed of the first and second gathering rolls 18 and 19 may be, for example, 125 m/min and, respectively, 105 m/min at the most. The exit speed of the weight-enhanced sliver B discharged by the calender rolls 11, 12 may be approximately 20 m/min or more. Also referring to FIG. 2, the clothing teeth 5*b* of the doffer 5 are oriented rearwardly with respect to its direction of rotation. The clothing teeth 6*b* of the stripping roll 6 are essentially radially oriented. The clothing teeth 18*b* of the first gathering roll 18 are oriented rearwardly relative to its rotary direction whereas the clothing teeth of the second gathering roll 19 are oriented rearwardly with respect to its direction of rotation. By virtue of the gathering device 17 according to the invention, comprising the two gathering rolls 18 and 19 illustrated in FIG. 1, a negative draft, that is, an accumulation of the fiber material is effected at the first gathering roll 18 with respect to the doffer 5 in a ratio of approximately 1:3 to 1:5 and at the second gathering roll 19 with respect to the doffer 5 in a ratio of approximately 1:3 to 1:6. In this manner a heavy sliver B may be made, having a sliver weight of, for example, 80–150 g/m.

As shown in FIG. 2, between the doffer 5 and the stripping roll 6 a single gathering roll 18 is provided which cooperates with the doffer 5 and the stripping roll 6.

As shown in FIG. 3, the gathering rolls 18 and 19 are driven by respective rpm-regulated motors 24 and 25 which may be a.c. servomotors and which are coupled to an electronic control and regulating device 26. Such a control system may set the negative draft (accumulation) of the fiber material to the desired extent.

As shown in FIG. 4, the calender rolls 11, 12 at the output of the carding machine are followed by a regulated draw unit 20 with which irregularities in the sliver B may be evened, particularly as concerns sliver thickness and structure. The intake roll pair 20*a* and the mid roll pair 20*b* are driven by an rpm-regulated electric motor 21 and the output roll pair 20*c* is driven by an rpm-regulated electric motor 22. The motors 21 and 22 are connected to an electronic control and regulating device 23.

Figure 5:
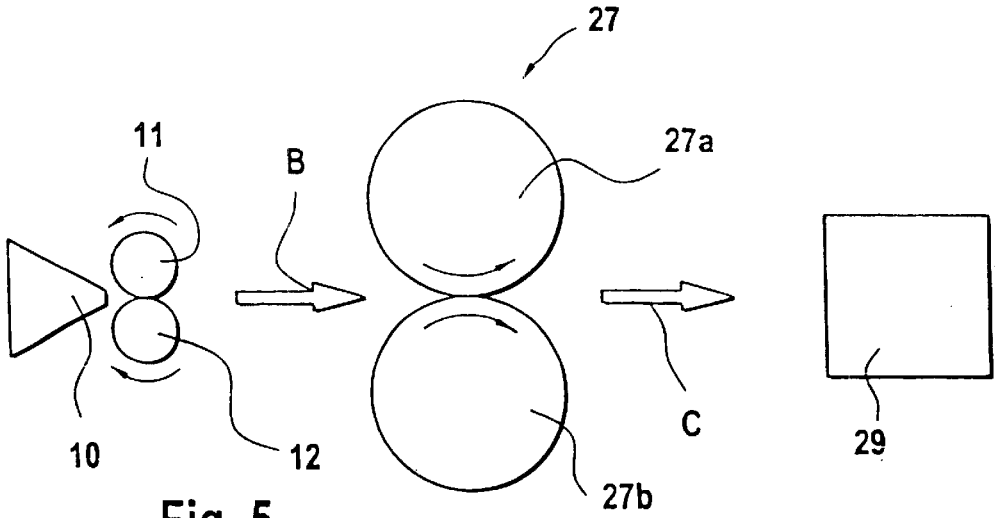
FIG. 5 is a schematic side elevational view of a calender assembly following a sliver forming device.

Turning to FIG. 5, the calender rolls 11, 12 of the carding machine are followed by a reinforcing device 27 having two calender rolls 27*a* and 27*b* which serve for reinforcing the fiber web or the sliver B by pressure or profiling. By virtue of this arrangement structural changes are compensated for which may appear in the course of the gathering process and at the same time, the fiber web or sliver B is improved for further processing. The reinforcing device 27 is followed by a processing device 29 which may be an automatic apparatus for making sanitary napkins. To achieve a high output speed and output quantity, advantageously the speed of the sliver B exiting the carding machine and the speed of the sliver C entering the after-connected processing machine 29 are adapted to one another. In such a case no intermediate storage arrangement for the sliver is required. The adaptation is effected by a non-illustrated electronic control and regulating device which is connected with the rpm-regulated drive motors of the carding machine and the processing machine 29.

Figure 6:
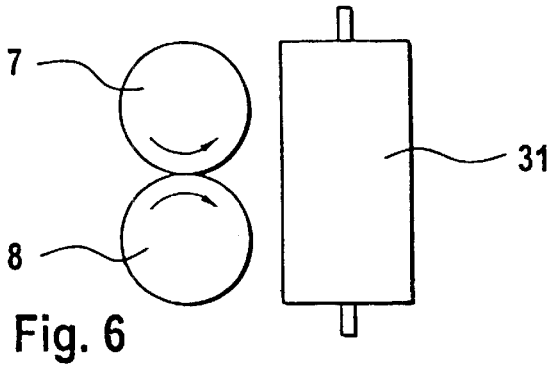
FIG. 6 shows two crushing rolls and a transverse fiber web pull-off device.

It is noted that in a carding machine for practicing the invention instead of the traveling flats assembly 13 exclusively stationary carding elements, and instead of the fiber web guiding elements 9 a transverse fiber web pull-off unit 31 as shown in FIG. 6 may be used.

In case an intermediate storage arrangement is required, the sliver B may be deposited in a non-illustrated coiler can.

It will be understood that the above description of the present invention is susceptible to various modifications, changes and adaptations, and the same are intended to be comprehended within the meaning and range of equivalents of the appended claims.

What is claimed is:

1. In a carding machine including a main carding cylinder, a doffer to which fiber material is transferred from the main carding cylinder and a fiber removing device positioned downstream of the doffer as viewed in an advancing direction of the fiber material through the carding machine; the improvement comprising a gathering device including at least one gathering roll disposed between said doffer and said fiber removing device for effecting a negative draft on the fiber material between said doffer and said gathering roll.

2. The improvement as defined in claim 1, wherein said doffer and said gathering roll are in a cooperating working relationship with one another.

3. The improvement as defined in claim 1, wherein said gathering device includes first and second gathering rolls disposed downstream of said doffer for effecting a negative draft on the fiber material between said doffer and said first gathering roll and between said doffer and said second gathering roll.

4. The improvement as defined in claim 3, wherein said first gathering roll is in a working relationship with said doffer.

5. The improvement as defined in claim 3, wherein said second gathering roll is in a working relationship with said first gathering roll.

6. The improvement as defined in claim 3, further comprising means for driving said first gathering roll in a given direction of rotation and clothing teeth provided on said first gathering roll; said clothing teeth being oriented rearwardly relative to said direction of rotation.

7. The improvement as defined in claim 3, further comprising means for driving said second gathering roll in a given direction of rotation and clothing teeth provided on said second gathering roll; said clothing teeth being oriented rearwardly relative to said direction of rotation.

8. The improvement as defined in claim 3, wherein said negative draft between said doffer and said first gathering roll is 1:3 to 1:5.

9. The improvement as defined in claim 3, wherein said negative draft between said doffer and said second gathering roll is 1:3 to 1:6.

10. The improvement as defined in claim 1, further comprising an rpm-regulated drive coupled to said gathering roll.

11. The improvement as defined in claim 3, further comprising first an d second rpm-regulated drives coupled to said first and second gathering rolls, respectively.

12. The improvement as defined in claim 1, in combination with a sliver draw unit disposed downstream of said fiber removing device for receiving sliver from said carding machine.

13. The improvement as defined in claim 12, wherein said sliver draw unit includes rpm-regulated drawing roll pairs through which the sliver passes.

14. The improvement as defined in claim 1, in combination with a fiber reinforcing device disposed downstream of said fiber removing device for receiving sliver from said carding machine.

15. The improvement as defined in claim 14, wherein said fiber reinforcing device comprises a calender roll pair through which the sliver passes.

16. The improvement as defined in claim 1, wherein said fiber removal device comprises a stripping roll.

17. The improvement as defined in claim 1, wherein said fiber removing device comprises a transverse fiber web pull-off unit.

18. The improvement as defined in claim 1, further comprising means for driving said doffer at a first speed and means for driving said gathering roll at a second speed; said second speed being less than said first speed.

19. The improvement as defined in claim 18, wherein said gathering roll is a first gathering roll; further comprising a second gathering roll disposed downstream of and cooperating with said first gathering roll; and means for driving said second gathering roll at a third speed which is less than said second speed.

20. The improvement as defined in claim 19; further comprising means for rotating said doffer, said first gathering roll and said second gathering roll in respective first, second and third directions; said second direction being opposite to said first and third directions.

21. In a carding machine including a main carding cylinder, a doffer to which fiber material is transferred from the main carding cylinder and a fiber removing device positioned downstream of the doffer as viewed in an advancing direction of the fiber material through the carding machine; the improvement comprising a gathering device including first and second gathering rolls disposed downstream of said doffer for effecting a negative draft on the fiber material between said doffer and said first gathering roll and between said doffer and said second gathering roll.

22. The improvement as defined in claim 21, wherein said first gathering roll is in a working relationship with said doffer.

23. The improvement as defined in claim 21, wherein said second gathering roll is in a working relationship with said if first gathering roll.

24. The improvement as defined in claim 21, further comprising means for driving said first gathering roll in a given direction of rotation and clothing teeth provided on said first gathering roll; said clothing teeth being oriented rearwardly relative to said direction of rotation.

25. The improvement as defined in claim 21, further comprising means for driving Bald second gathering roll in a given direction of rotation and clothing teeth provided on said second gathering roll; said clothing teeth being oriented rearwardly relative to said direction of rotation.

26. The improvement as defined in claim 21, wherein said negative draft between said doffer and said first gathering roll is 1:3 to 1:5.

27. The improvement as defined in claim 21, wherein said negative draft between said doffer and said second gathering roll is 1:3 to 1:6.

28. The improvement as defined in claim 21, further comprising first and second rpm-regulated drives coupled to said first and second gathering rolls, respectively.

29. In a carding machine including a main carding cylinder, a doffer to which fiber material is transferred from the main carding cylinder and a fiber removing device positioned downstream of the doffer as viewed in an advancing direction of the fiber material through the carding machine; the improvement comprising (a) means for driving said doffer at a first speed;

(b) a first gathering roll disposed downstream of said doffer;

(c) means for driving said first gathering roll at a second speed less than said first speed for effecting a negative draft on the fiber material between said doffer and said first gathering roll;

(d) a second gathering roll disposed downstream of and cooperating with said first gathering roll; and (e) means for driving said second gathering roll at a third speed less than said second speed for effecting a negative draft on the fiber material between said doffer and said second gathering roll.

30. The improvement as defined in claim 29, further comprising means for rotating said doffer, said first gathering roll and said second gathering roll in respective first, second and third directions; said second direction being opposite to said first and third directions.

* * * * *